US006523858B2

(12) United States Patent
Takemura

(10) Patent No.: US 6,523,858 B2
(45) Date of Patent: Feb. 25, 2003

(54) PRESENTATION DISPLAY DEVICES WITH HOLDERS

(75) Inventor: Shun Takemura, Pacific Palisades, CA (US)

(73) Assignee: Itoya of America, Ltd., Torrance, CA (US)

( * ) Notice: Subject to any disclaimer, the term of this patent is extended or adjusted under 35 U.S.C. 154(b) by 0 days.

(21) Appl. No.: 09/895,129

(22) Filed: Jun. 29, 2001

(65) Prior Publication Data

US 2002/0149193 A1 Oct. 17, 2002

Related U.S. Application Data

(63) Continuation-in-part of application No. 09/833,919, filed on Apr. 11, 2001, now abandoned.

(51) Int. Cl.[7] ..... B42D 3/00

(52) U.S. Cl. ..... 281/29; 281/15.1; 281/45; 248/441.1

(58) Field of Search ..... 281/15.1, 29, 33, 281/36–38, 45, 51; 248/441.1, 445, 447; 402/70, 73, 76, 77, 80 R; 40/124.01, 124.06, 124.16, 124.19

(56) References Cited

U.S. PATENT DOCUMENTS

| | | | | | |
|---|---|---|---|---|---|
| 2,091,260 | A | * | 8/1937 | Farkas et al. | 248/447 |
| 2,550,279 | A | * | 4/1951 | Mamer | 248/453 |
| 3,638,967 | A | * | 2/1972 | Mullins | 281/29 |
| 4,703,952 | A | * | 11/1987 | Biasini | 229/72 |
| 5,509,746 | A | * | 4/1996 | Ho | 281/33 |

* cited by examiner

*Primary Examiner*—A. L. Wellington
*Assistant Examiner*—Monica Carter
(74) *Attorney, Agent, or Firm*—Squire, Sanders & Dempsey, L.L.P.

(57) ABSTRACT

An item, such as a folder, binder or book is converted into a presentation or display device by affixing thereto a display stand, which when not being used as display stand nests about the outside of the covers of the item whose contents are to be displayed. Also included are holders for the corners of the pages to be displayed. When the covers of the item are fully opened at 180° so that the contents thereof can be displayed page at a time, the stand folds into a supporting structure of generally triangular cross-section with an upper edge thereof engaged with tabs extending outwardly from the covers of the item. At the same time, the corners of the displayed pages can be placed in the holders to assure that the pages are displayed flat and do not sag under the influence of gravity.

40 Claims, 4 Drawing Sheets

PRESENTATION DISPLAY DEVICES WITH HOLDERS

This application is a CIP of Ser. No. 09/833,919, filed Apr. 11, 2001, now abandoned.

BACKGROUND OF THE INVENTION

Many different kinds of portfolios, binders, books, and folders exist, which hereinafter will be referred to generally as folders. Some well known types include three ring binders, spiral-bound notebooks and clasped folders. These are used to retain individual sheets, usually of paper, so that they can viewed as if they were bound in a book. Sometimes clear envelopes are included to retain and protect flat items for later display or study. These retained items typically include warranties, magazine clippings, reports and graphs, certificates, legal documents, photographs and negatives, collectible stamps and any other flat items including pressed flowers or other organic samples, where clear, usually plastic, envelopes can provide safe storage and display.

When viewing what is stored within such a folder, it is normal to open the folder so that its front and back covers lay flat on a surface, or to hold the front and back covers manually while turning the pages. This is particularly inconvenient when self-display of sheets is desired. Therefore, there are many devices to support folders, books and other information containing devices, such as with racks or devices. U.S. Pat. No. 5,586,786 by Liang-Feng Su teaches a triangular easel held in display position with the assistance of a hook and loop fastening system, formed from the cover of a book so that one page at a time can be flipped over the apex of the triangle for display.

However, there has been a need for a display device for folders which allows the folders to be displayed in an open position with pages side to side like a book. In addition, there is a need to provide a device that can be added to the covers of existing devices, either during the production thereof or later to add the above-mentioned display feature thereto. Such devices, to be commercially viable must be extremely economical to produce, easily adaptable to most prior art folders, and light-weight, and constructed and installed so it does not interfere with any of the normal functionality of a portfolio, binder, book, or folder.

SUMMARY OF THE INVENTION

The present invention includes a support sheet made of relatively stiff paperboard, plastic or a combination thereof, which is used to convert a folder for containing flat sheets of display material into an open display device, which supports itself from a horizontal surface substantially vertical. The support sheet includes two vertical creases, partial cuts, or perforation lines therein (hereinafter referred to as creases), centrally spaced and just further apart than the normal maximum thickness of the folder to be displayed so that the support sheet can nest about the outside surfaces of the covers and spine of the folder when the folder is closed. The support sheet is loosely connected to the folder by a plurality of fasteners near its bottom edge to the area adjacent the bottom edge of the folder. Typical fasteners for attachment include rivets, or fender screws and T nuts. The fasteners may be separate components, or if plastic rivets, may be integral with the support sheet. The fasteners extend through horizontally elongated holes so that the support sheet and covers can slide relative to each other a shall amount as the folder is opened and closed to accommodate the thickness of the covers and the support sheet without buckling. Although the support sheet may be fixed with respect to one cover and mounted loosely with respect to the other, better folding occurs when the support sheet is loosely connected to both covers.

The support sheet is formed into a support member by providing a first horizontal crease just above the fasteners, and a second horizontal crease at about 30 to 40% of the remaining distance to the top edge of the sheet. No bending occurs at the horizontal creases when the support sheet is not in use as a support, and is nested against the outer surfaces of the covers and the spine of the folder. Thus, three horizontal ribbons of material are formed by the horizontal creases, a lower narrow ribbon for attachment to the folder, a middle medium sized ribbon for forming, when folded, the base of the support member, and an upper ribbon whose upper edge releasably engages with the front and back covers to retain the covers in a plane and to support them in a generally upright position. The attachment of the upper edge of the support sheet to the covers typically is by sliding the upper edge under downwardly facing tabs formed by cut-outs in the covers or cut outs in small tab members attached to the outside of stiff covers. The relative length of the middle ribbon and the upper ribbon primarily determines the angle, close to vertical, at which the pages within the folder will be displayed. The lower ribbon may have a cut-out adjacent the spine area of the folder to allow a portion of the spine to be displayed and to ease folding of the folder.

In addition, corner holders are provided either on separate relatively stiff sheets or at the lower inner corners of the covers. The corner holders are used to retain the lower, outer corners of the display pages to prevent the display pages from sagging under the force of gravity when the folder is open and being used for display.

Therefore, it is an object of the present invention to provide a light and economical folder with a display support, which increases the utility of the folder, especially those equipped with transparent envelopes for the display of information on sheets that need to be held flat.

Another object is to provide a display support for prior art folders and page supports which can be added to a folder or binder after manufacture.

Another object is to provide a display support for folders that holds the front and rear covers of such folders in a plane and nearly vertical when placed on a horizontal surface and holds the display pages therein against the covers.

Another object is to provide a folder support which allows a folder to remain upright and stable on a horizontal surface while its interior pages are being turned.

These and other objects and advantages of the present invention will become apparent to those skilled in the art after considering the following detailed specification and drawings wherein:

DETAILED DESCRIPTION OF THE SHOWN EMBODIMENTS

Figure 1:
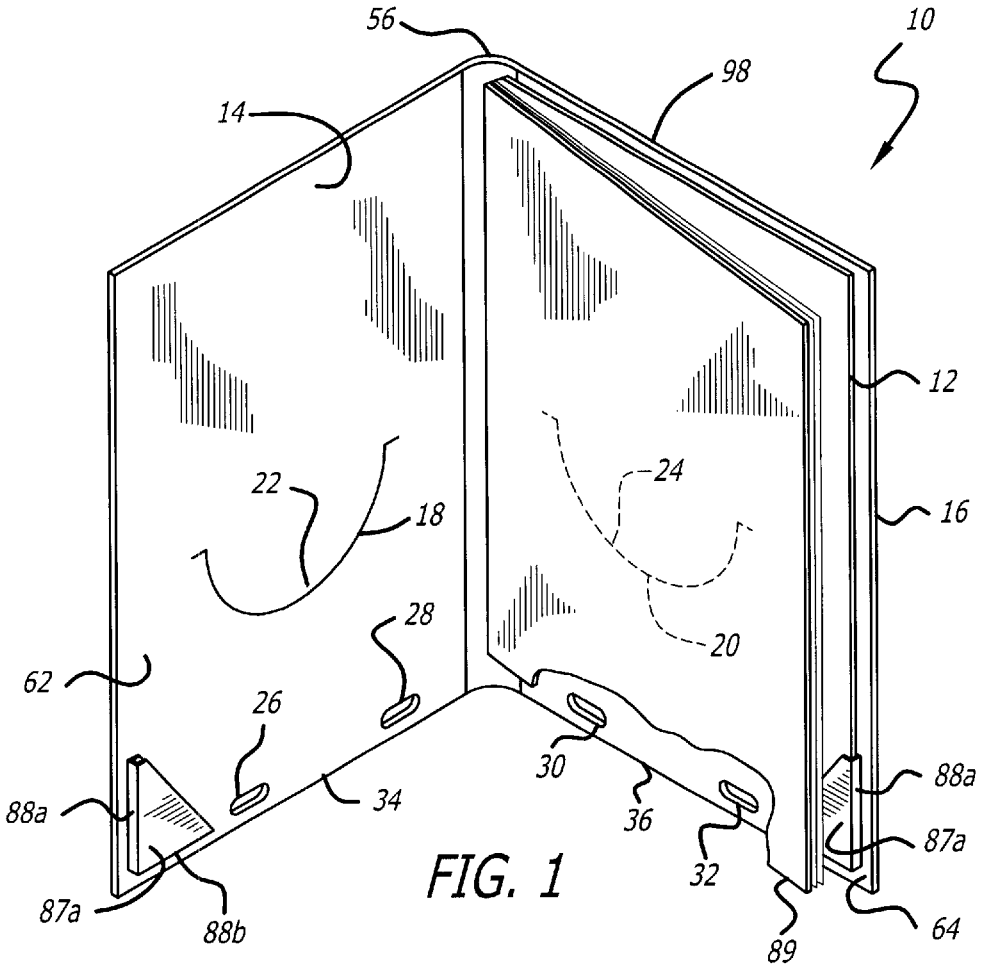
FIG. 1 is a perspective view of a folder partly open and modified during manufacture or thereafter for use with the display support of the present invention, a portion of the transparent pages thereof being cut away.

Referring to the Figures more particularly by reference numbers, number 10 in FIG. 1 refers to a typical folder including transparent pages 12, the folder 10 having been modified in accordance with the present invention. The front and back covers 14 and 16 are shown including upward facing crescent cutouts 18 and 20, respectively, to form downward facing tabs 22 and 24 in the front and back covers 14 and 16, respectively. Generally the tabs 22 and 24 are positioned at midpoints in the covers 14 and 16, although their exact location is not critical. Generally a tab 22 or 24 in each cover 14 or 16 is all that is required. However additional tabs can be included if the folder 10 has a strong memory for the closed position to assist in maintaining the folder 10 in an open position.

Figure 2:
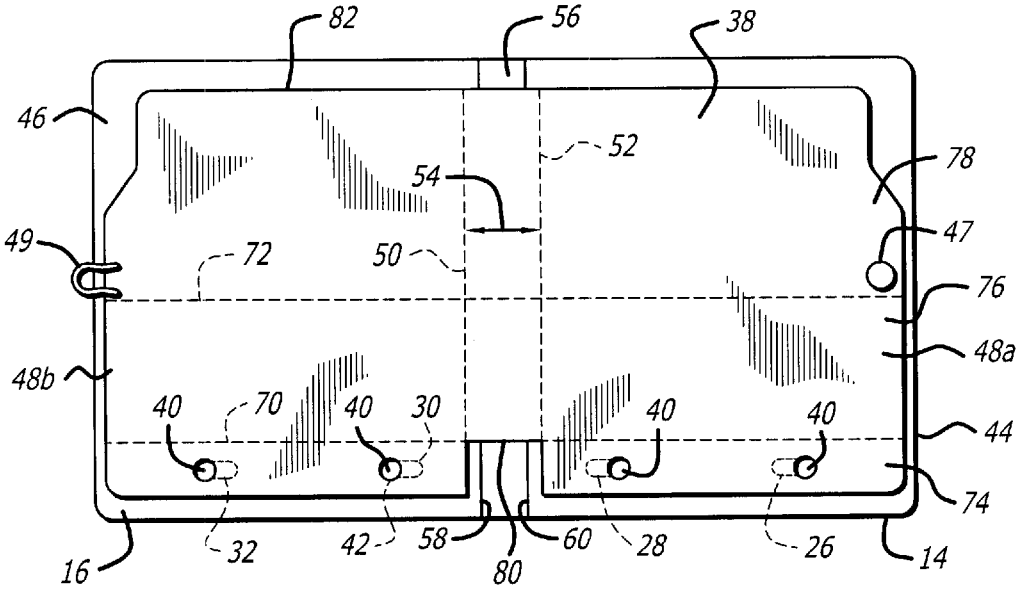
FIG. 2 is a front elevational view of the folder of FIG. 1 with a display support attached thereto, the folder and display support being in generally the open planer positions thereof.
Figure 3:
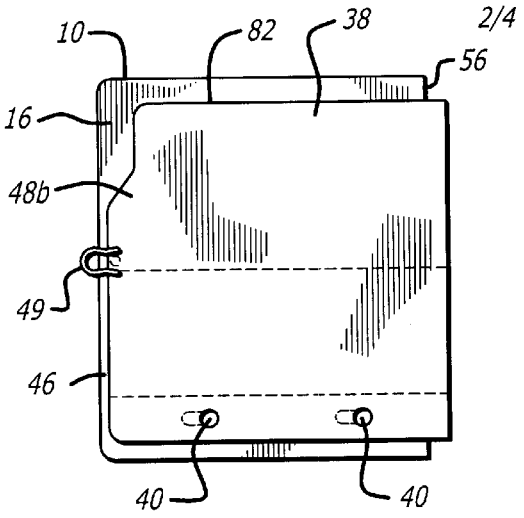
FIG. 3 is an elevational view of the assembly of FIG. 2 folded, the back cover and adjacent portion of the display support being shown.
Figure 4:
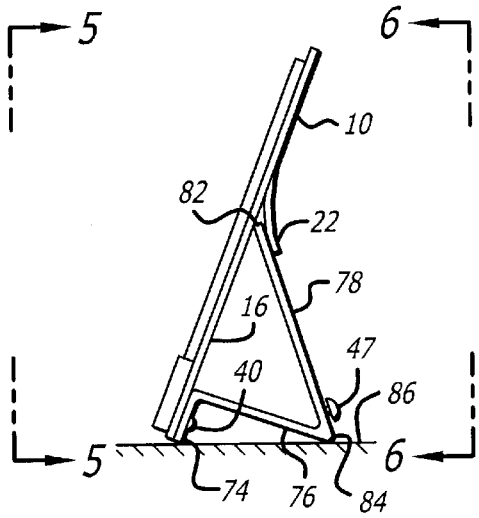
FIG. 4 is an edge elevational view of the assembly of FIGS. 2 and 3 with the display support folded and its upper edge tucked under tabs extending from the folder covers.

The covers 14 and 16 are shown having horizontally elongated holes 26 and 28 in cover 14, and horizontally elongated holes 30 and 32 in cover 16 near the bottom edges 34 and 36 thereof. As shown in FIG. 2, a display support 38 is connected to the covers 14 and 16 at the holes 26, 28, 30 and 32 by means of rivets 40, or other suitable fasteners such as screws and flat nuts, which also extend through holes 42 in the support 38 and into the holes 26, 28, 30 and 32 for sliding connection against the outer surfaces 44 and 46 of the covers 14 and 16. In fact, the elongated holes 26, 28, 30 and 32 instead can be formed in the support 38 and the rivets 40 positioned in fixed locations with respect to the covers 14 and 16. Although the folder 10 is shown as having transparent pages 12 permanently bound therein, in fact the folder 10 may be a looseleaf binder, a spiral bound notebook, a conventionally bound book or similar structures. When spiral bound, the holes 26, 28, 30 and 32 are usually lengthened so that the support 38 can accommodate the bulk of the spiral binding when the notebook is folded closed. As shown in FIGS. 2, 3, and 4, closure means such as a button 47 can be attached to the support 38 at one side 48*a* thereof while at the other side 48*b*, an elastic loop 49 may be attached. As shown in FIG. 3, when the loop 49 is stretched around the sides 48*a* and 48*b* to engage the button 47, the folder 10 is maintained in the closed position.

The support 38 includes at least two vertical creases or cuts 50 and 52 which are horizontally spaced a distance, shown by the arrow 54, that is slightly wider than the width of the spine 56 about which the covers 14 and 16 fold along lines 58 and 60. Note in FIG. 2 that the holes 26, 28, 30 and 32 extend inwardly toward the spine 56 since when the covers 14 or 16 are closed, the extra distance around the covers 14 and 16 and the spine 56 must be accommodated by the support 38. This can be seen in FIG. 3 where the holes 30 and 32 extend away from the spine 56 from the rivets 40. The opposite would be true if the elongated holes were formed in the support 38.

When the folder 10 is open, the pages 12 are supported for display by the inner surfaces 62 and 64 of the front and back covers 14 and 16 respectively. If the pages 12 are relatively stiff, no additional support is needed.

Two horizontal creases or cuts 70 and 72 extend across the support 38 to form a lower attachment ribbon 74, a mid-base forming ribbon 76, and an upper upright support ribbon 78. The lower attachment ribbon 74 may include a cutout 80 adjacent the spine 56 to allow easy folding and to reduce weight.

As shown in FIG. 4, when the folder 10 is fully opened so that its covers 14 and 16 extend generally in a single plane, the mid-base forming ribbon 76 can be folded out from the folder 10 away from the attachment ribbon 74 with its attachment fasteners 40. Then the upper upright support ribbon 78 can be folded back toward the folder 10 so that its upper edge 82 can be slid underneath the tabs 22 and 24. Thereafter, the lower surface 16 and the intersection 84 between the ribbons 76 and 78 form two parallel support lines of contact to maintain the folder 10 in the generally upright position shown in FIG. 4 when placed on a horizontal surface 86.

Figure 5:
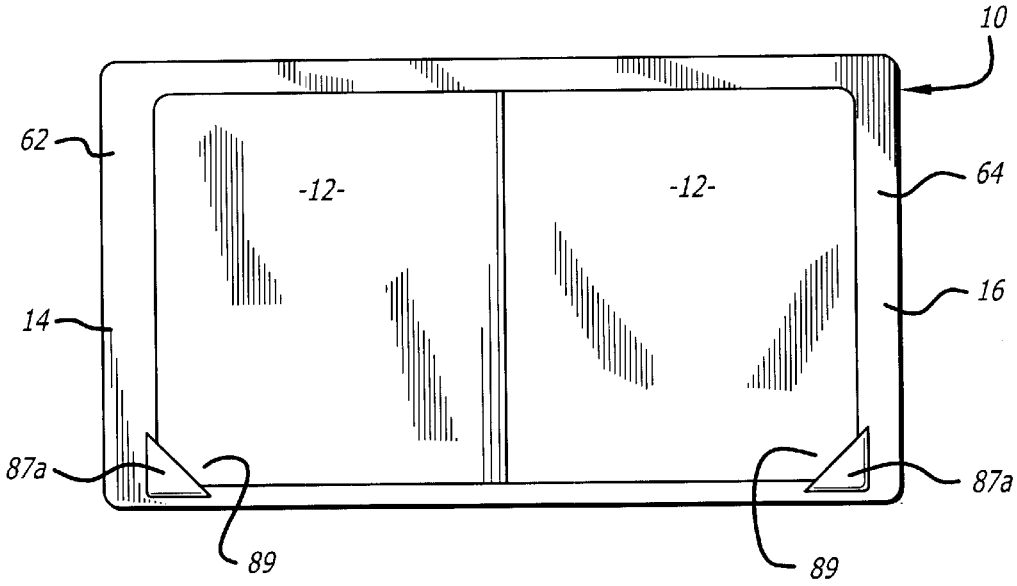
FIG. 5 is an elevational view taken at line 5—5 in FIG. 4 showing the folder in an open and supported position.
Figure 5A:
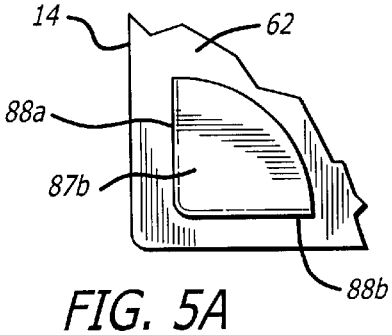
FIGS. 5A and 5B are detail elevational views of corner holders attached to the covers of the folder.
Figure 5B:
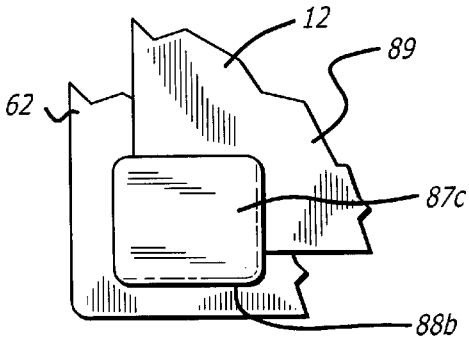

FIGS. 5, 5A and 5B show three different construction of corner holders 87*a*. 87*b* and 87*c* useful when the pages 12 are relatively limp and tend to sag under the force of gravity when the folder 10 is open. Holder 87*a* is a right triangle in shape. Holders 87*a* and 87*b* are permanently attached to the inner surfaces 62 and/or 64 of the covers 14 and 16 about their vertical and horizontal edges 88*a* and 88*b*, while holder 87*c* is attached only by its horizontal edge 88*b* and therefor acts more like a shelf than a pocket. Insertion of the corners 89 of the pages 12 in the holder 87*c* is generally easier than inserting the corners 89 into the holders 87*a* and 87*b*, which are advantageous because they have more holding power and don't require as rigid a material as do holders 87*c*.

Figure 6:
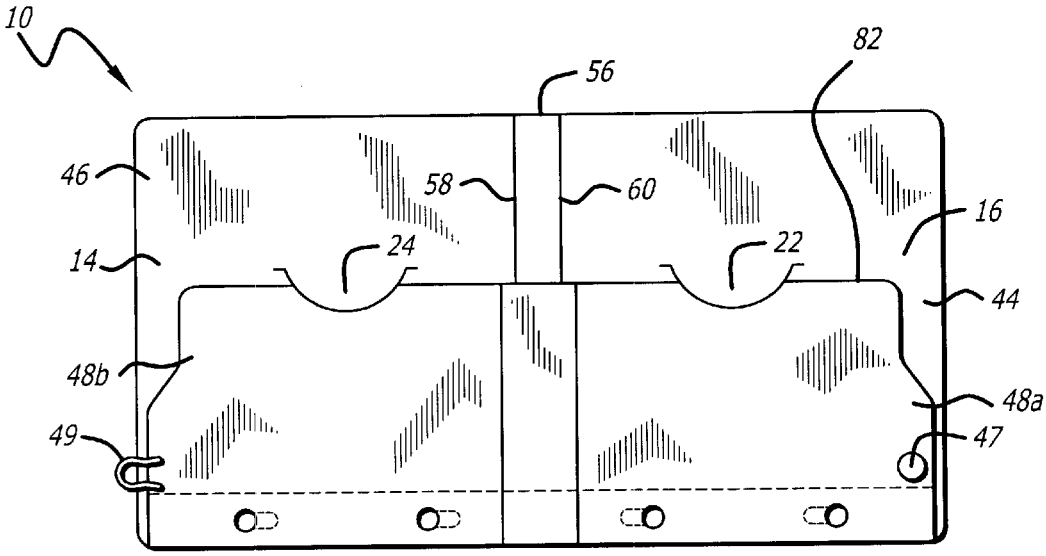
FIG. 6 is a view taken at line 6—6 in FIG. 4 showing a plan view of the display support, folded and connected to retain the folder in an upright position.

As shown in FIGS. 5 and 6, are elevational views of the inside and outside of the folder 10. The support 36 allows the folder 10 to be supported for easy viewing of the pages 12 therein, while the support 38 is maintained in a stable position through abutment with the tabs 22 and 24. Instead of tabs 22 and 24, a hook and loop fastener system could be used, but such is relatively expensive and bulky.

Figure 7:
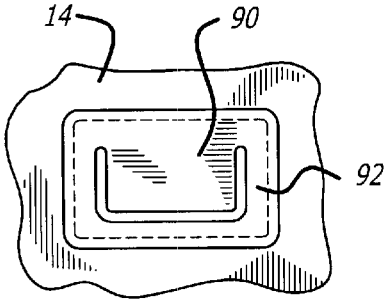
FIG. 7 shows a modified tab portion for connection to a folder when the covers of the folder are made from non-flexible material.
Figure 8:
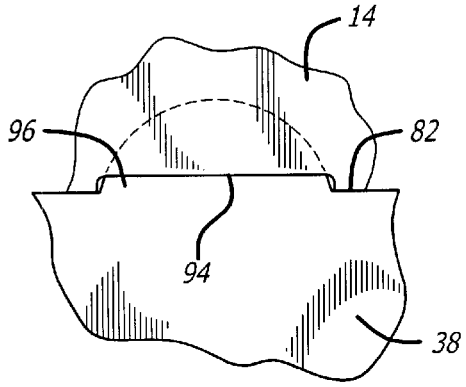
FIG. 8 is an enlarged view of a tab portion of a modified display support where the tab is formed in the upper surface of the support and a slot is provided in the cover of the folder.

As shown in FIG. 7, a tab 90 can be formed on a separate patch 92, for permanent connection by its edges to the outside of a cover 14 or 16 which is made from material too stiff to allow a tab 22 or 24 to be flexed outwardly to engage the support 38. Also note that the tab 90 has other than a crescent shape with many suitable shapes being possible, but preferably avoiding sharp corners as they tend to catch when the upper edge 82 of the support 38 is engaged with a tab. It is also possible to have tabs 94 formed in upper edge 82 of the support 38 to extend into slots 96 in the covers 14 and 16 (FIG. 8). Generally this is less desirable than the construction shown in the preceding Figures since when the tab 94 is not engaged, it either extends beyond the upper edge 98 of a cover or requires that the upper support ribbon 78 be restricted in height.

Figure 9A:
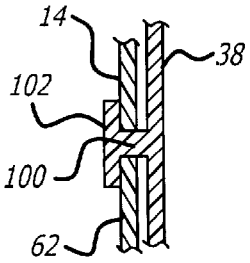
FIGS. 9A, 9B, and 9C are enlarged side cross-sectional views of an integral rivet, a T nut and fender screw, and a upset rivet respectively, such as can be used to retain the display support to a folder.
Figure 9B:
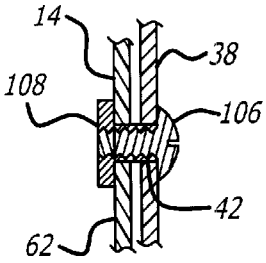
Figure 9C:
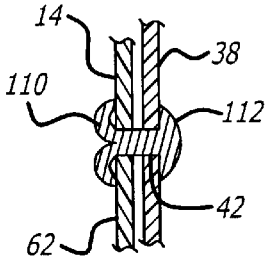

Typical fasteners are shown in the cross-sectional views of FIGS. 9A, 9B, and 9C. In FIG. 9A, a integral plastic rivet 100 extends from the support device 38 and through the cover 14 with its upset head 102 adjacent the inner surface 104 of the cover 14. In FIG. 9B, a fender screw 106 extends through the support device 38 to engage with a T nut 108 extending through the cover 14. In FIG. 9C, a separate rivet 110 extends through the support device 38 and through the cover 14 with its upset head 112 adjacent the inner surface 104 of the cover 14.

Figure 10:
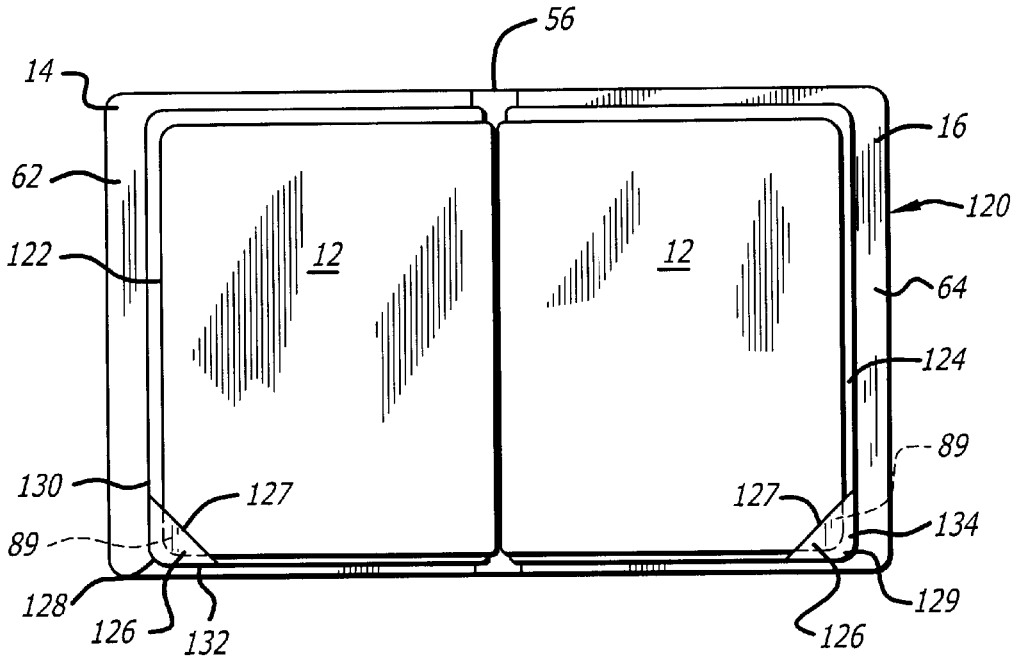
FIG. 10 is an elevational view of a modified folder in an open and supported position with the display pages therein being held flat by separate, relatively stiff flat sheets.

FIG. 10 is an elevational view of a modified folder 120 in an open and supported position that does not include the holders 87*a*, 87*b* or 87*c*. Instead, the display pages 12 therein are being held flat by separate, relatively stiff flat sheets 122 and 124 positioned between the pages 12 and the front and back covers 14 and 16 respectively and connected to the spine 56. Holders 126 like holders 87*a*, 87*b* or 87*c*, having open diagonal edges 127, are provided at the outer, lower corners 128 and 129 of the sheets 122 and 124 allowing insertion of the corners 89 of the pages 12 to retain them flat and parallel to the covers 14 and 16 for viewing. The holders 126 may be constructed from a suitable shape that is then heat welded along their vertical and horizontal edges 130 and 132. They can also be constructed from a fold over tab 134 that is folded along one edge and welded along its other.

Figure 11:
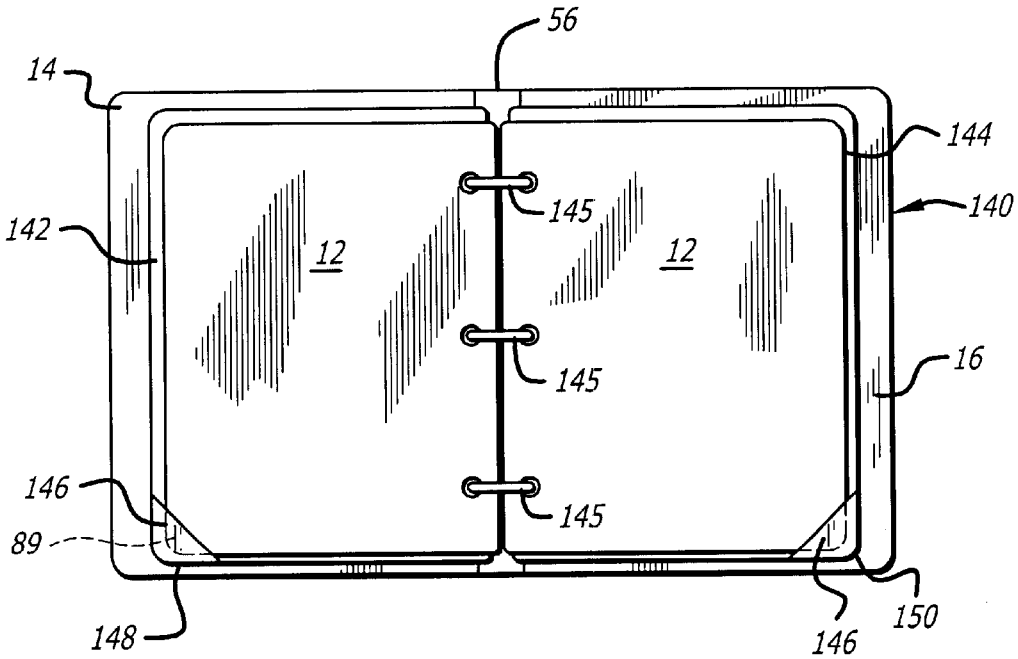
FIG. 11 is an elevational view of a modified folder in the form of a three ring binder, in an open and supported position with the display pages therein being held flat by one of the separate, relatively stiff flat sheets.

FIG. 11 is an elevational view of a three ring binder 140 in an open and supported position with the display pages therein being held flat by one of the separate relatively stiff flat sheets 142 and 144 positioned between the pages 12 and the front and back covers 14 and 16 respectively, and connected to the binder 140 by its rings 145. Holders 146 like holders 126, 87*a*, 87*b* or 87*c* are provided at the outer, lower corners 148 and 150 of the sheets 142 and 144 for insertion of the corners 89 of the pages 12 to, retain them flat and parallel to the covers 14 and 16 for viewing.

Thus, there has been shown and described presentation displays which fulfill all of the objects and advantages sought therefore. Many changes, alterations, modifications, and other uses and applications of the subject invention, become apparent to those skilled in the art after considering the specification together with the accompanying drawings. All such changes, alterations, and modifications which do not depart from the spirit and scope of invention are deemed to be covered by the invention, which is limited only by the claims that follow.

What is claimed is:

1. A display device comprising:

a protector for holding generally planar displays having:
- a generally planar front cover;
- a generally planar rear cover;
- means for connecting said generally planar front and rear covers together, whereby said generally planar front cover and said generally planar rear cover can be placed generally in spaced parallel and facing relationship, a planar relationship or any position there between, said generally planar front and rear covers each including:
  - an outer surface;
  - an inner surface;
  - an upper edge;
  - a lower edge;
  - connection means positioned generally vertically between said upper and lower edges; and
  - at least one cover fastener hole formed therein spaced from said lower edge; and
- means to hold corners of the generally planar displays; and a support sheet of material stiff enough to be self supporting loosely connected to said generally planar front and rear covers at said cover fastener holes, said support sheet including:
- an upper edge portion;
- a lower surface;
- at least one vertical fold in general alignment with said means for connecting said generally planar front and rear covers together;
- a first horizontal fold extending generally parallel to said lower surface and spaced therefrom;
- support fastener holes positioned there between;
- fasteners extending through said cover fastener holes and said support fastener holes to hold said support loosely to said covers; and
- a second horizontal fold generally parallel to and spaced upwardly from said first horizontal fold so that said support sheet further includes:
  - a generally horizontal support ribbon above said second horizontal fold; and
  - a generally horizontal base ribbon above said first horizontal fold and below said second horizontal fold, whereby when said base ribbon is folded outwardly from said generally planar front and rear covers and said upper edge portion is placed in engagement with said connection means and the generally planar displays are positioned in said means to hold corners, said lower edge and said second horizontal fold are positioned for engagement with a flat generally horizontal supporting surface so that said protector can be supported generally upright thereby and the generally planar displays are retained generally flat.

2. The display device as defined in claim 1 wherein said means to hold corners of the generally planar displays include:

a first corner support connected to said inner surface at said lower edge of said generally planar front cover; and a second corner support connected to said inner surface at said lower edge of said generally planar rear cover.

3. The display device as defined in claim 2 wherein said first and second corner supports are pockets having:

a generally triangular shape; and an open diagonal edge facing the generally planar displays.

4. The display device as defined in claim 1 wherein said means to hold corners of the generally planar displays include:

a corner support connected to said inner surface at said lower edge of said generally planar rear cover having:
- a vertical edge attached to said inner surface of said generally planar rear cover;
- a horizontal edge attached to said inner surface of said generally planar rear cover; and
- an open edge between said vertical and horizontal edges facing the generally planar displays.

5. The display device as defined in claim 1 wherein said means to hold corners of the generally planar displays include:

a first sheet positioned adjacent said inner surface of said generally planar front cover and having:

a first corner support near said generally planar front cover lower edge including:

a first opening facing the generally planar displays; and a second sheet positioned adjacent said inner surface of said generally planar rear cover and having:

a second corner support near said generally planar rear cover lower edge including:

a second opening facing the generally planar displays.

6. The display device as defined in claim 5 wherein said first corner support is a pocket with a generally right triangle shape, and wherein said first opening includes:

a first open diagonal edge facing the generally planar displays, and wherein said second corner support is a pocket with a generally right triangle shape, and wherein said second opening includes:

a second open diagonal edge facing the generally planar displays.

7. The display device as defined in claim 5 wherein said second corner support includes:

a pocket flap having:

a vertical edge attached to said second sheet;

a horizontal edge attached to said second sheet; and an open edge between said vertical and horizontal edges facing the generally planar displays.

8. The display device as defined in claim 5 wherein said means for connecting said generally planar front and rear covers together include:

a plurality of generally planar display holders, said generally planar display holders having:

a generally rectangular shape; and a first stiffness, and wherein said means to hold corners of the generally planar displays include:

a first sheet positioned adjacent said inner surface at said lower edge of said generally planar front cover and having:

a second stiffness more stiff than said first stiffness; and a first lower outer corner pocket facing said generally planar display holders; and a second sheet positioned adjacent said inner surface at said lower edge of said generally planar rear cover having:

a third stiffness more stiff than said first stiffness; and a second lower outer corner pocket facing said generally planar display holders.

9. The display device as defined in claim 8 wherein said means for connecting said generally planar front and rear covers together include:

a spine having:

a first width, and wherein said support sheet includes in addition to said at least one vertical fold:

a second vertical fold, said vertical folds being spaced greater distance than said first width, said generally planar display holders being connected to said spine.

10. The display device as defined in claim 9 wherein said first horizontal fold extending generally parallel to said lower surface and spaced therefrom forms:

connection ribbons between said first horizontal fold and said lower edge positioned along each said generally planar cover.

11. The display device as defined in claim 10 wherein at least one of said fastener holes of each fastener hole though which a said fastener extends is a horizontally elongate hole.

12. The display device as defined in claim 1 further including:

closure means to releasably retain said generally planar front cover and said generally planar rear cover in closed generally parallel positions.

13. The display device as defined in claim 12 wherein said support sheet includes:

a front side edge; and a rear side edge, and wherein said closure means include:

a button connected to a said side edge of said support sheet adjacent said outer surface of one of said generally planar covers; and an elastic loop connected to the other of said side edges adjacent said other generally planar cover, whereby looping of said elastic loop about said button retains said generally planar front and rear covers in closed generally parallel positions.

14. The display device as defined in claim 1 wherein said first horizontal fold extending generally parallel to said lower surface and spaced therefrom forms:

at least one connection ribbon between said first horizontal fold and said lower edge positioned along each generally planar cover, said at least one connection ribbon including:

at least two horizontally elongate fastener holes through which said fasteners extend to loosely connect said support sheet to said generally planar covers.

15. A display device comprising:

a protector for holding generally planar displays having:

a front cover;

a rear cover;

means for connecting said front and rear covers together, whereby said front cover and said rear cover can be placed generally in spaced parallel and facing relationship, a planar relationship or any position there between, said front and rear covers each including:

an outer surface;

an inner surface;

an upper edge;

a lower edge; and loose connection means positioned generally vertically between said upper and lower edges; and means to hold corners of the generally planar displays; and a support sheet of material stiff enough to be self supporting loosely connected to said front and rear covers by said loose connection means, said support sheet including:

an upper edge portion;

a lower surface;

at least one vertical fold in general alignment with said means for connecting said front and rear covers together;

a first horizontal fold extending generally parallel to said lower surface and spaced therefrom with said loose connection means positioned there between; and a second horizontal fold generally parallel to and spaced upwardly from said first horizontal fold so that said support sheet further includes:

a generally horizontal support ribbon above said second horizontal fold; and a generally horizontal base ribbon above said first horizontal fold and below said second horizontal fold, whereby when said base ribbon is folded outwardly from said front and rear covers and said upper edge portion is placed in engagement with said connection means and the generally planar displays are positioned in said means to hold corners, said lower edge and said second horizontal fold are positioned for engagement with a flat generally horizontal supporting surface so that said protector can be supported generally upright thereby and the generally planar displays are retained generally flat.

16. The display device as defined in claim 15 wherein said means to hold corners of the generally planar displays include:

a corner support connected to said inner surface at said lower edge of said rear cover.

17. The display device as defined in claim 16 wherein said corner support includes:

a vertical edge attached to said inner surface of said rear cover;

a horizontal edge attached to said inner surface of said rear cover; and an open edge between said vertical and horizontal edges facing the generally planar displays.

18. The display device as defined in claim 15 wherein said means to hold corners of the generally planar displays include:

a first sheet positioned adjacent said inner surface of said front cover having:

a first corner support near said front cover lower edge including:

a first opening facing the generally planar displays; and a second sheet positioned adjacent said inner surface of said rear cover and having:

a second corner support near said rear cover lower edge including:

a second opening facing the generally planar displays.

19. The display device as defined in claim 18 wherein said first corner support includes:

a flap having:

a vertical edge attached to said first sheet;

a horizontal edge attached to said first sheet; and an open edge between said vertical and horizontal edges forming said first opening.

20. The display device as defined in claim 15 wherein said means for connecting said front and rear covers include:

a plurality of generally planar display holders, said generally planar display holders having:

a generally rectangular shape; and a first stiffness; and wherein said means to hold corners of the generally planar displays include:

a sheet positioned adjacent said rear cover and having:

a second stiffness more stiff than said first stiffness; and a first corner support near said lower edge of said rear cover facing the generally planar displays.

21. A display device comprising:

a protector for holding generally planar displays having:

a generally planar front cover;

a generally planar rear cover; and means for connecting said front and rear covers together, whereby said front cover and said rear cover can be placed generally in spaced parallel and facing relationship, a planar relationship or any position therebetween, said generally planar front and rear covers each including:

an outer surface;

an upper edge;

a lower edge;

connection means positioned generally vertically between said upper and lower edges; and at least one fastener hole formed therein spaced from said lower edge; and a support sheet of material stiff enough to be self supporting loosely connected to said front and rear covers at said fastener holes, said support sheet including:

an upper edge portion;

a lower, surface;

at least one vertical fold in general alignment with said means for connecting said front and rear covers together;

a first horizontal fold extending generally parallel to said lower surface and spaced therefrom with said fastener holes positioned therebetween;

fasteners extending through said at least two fastener holes; and a second horizontal fold generally parallel to and spaced upwardly from said first horizontal fold so that said support sheet further includes:

a generally horizontal support ribbon above said second horizontal fold; and a generally horizontal base ribbon above said first horizontal fold and below said second horizontal fold, whereby when said base ribbon is folded outwardly from said front and rear covers and said upper edge portion is placed in engagement with said connection means, said lower edge and said second horizontal fold are positioned for engagement with a flat generally horizontal supporting surface so that said protector can be supported generally upright thereby.

22. The display device as defined in claim 21 wherein said connection means include:

at least one downwardly extending tab.

23. The display device as defined in claim 21 wherein each of said fasteners include:

an upset rivet connecting said support sheet to said protector.

24. The display device as defined in claim 21 wherein each of said fasteners include:

a rivet integral to said support sheet connecting said support sheet to said protector.

25. The display device as defined in claim 21 wherein each of said fasteners include:

a headed screw; and a T nut connecting said support sheet to said protector.

26. The display device as defined in claim 21 wherein said connection means include:

a patch connected to said outer surface of each of said covers, said patch including at least one downwardly extending and outwardly extendible tab.

27. The display device as defined in claim 21 wherein said means for connecting said front and rear covers together include:

a spine having:

a first width, and wherein said support sheet includes in addition to said at least one vertical fold:

a second vertical fold, said vertical folds being spaced greater than said first width.

28. The display device as defined in claim 27 wherein said first horizontal fold extending generally parallel to said lower surface and spaced therefrom forms:

connection ribbons between said first horizontal fold and said lower edge positioned along each cover.

29. The display device as defined in claim 27 wherein at least one of said at least one fastener holes formed in said generally planar front and rear covers is a horizontally elongate hole.

30. The display device as defined in claim 21 wherein said first horizontal fold extending generally parallel to said lower surface and spaced therefrom forms:

at least one connection ribbon between said first horizontal fold and said lower edge positioned along each cover, said at least one connection ribbon including:

at least two horizontally elongate fastener holes through which said fasteners extend to loosely connect said support sheet to said covers.

31. A support for a protector for holding generally planar displays that has a generally planar front cover, a generally planar rear cover; and means for connecting the front and rear covers together, whereby the front cover and the rear cover can be placed generally in spaced parallel and facing relationship, a planar relationship or any position therebetween, the generally planar front and rear covers each including an outer surface, an upper edge, a lower edge, connection means positioned generally vertically between said upper and lower edges; and at least one cover fastener hole formed therein spaced from the lower edge, wherein said support includes:

a support sheet of material stiff enough to be self supporting for loose connection to the front and rear covers at the fastener holes, said support sheet including:

an upper edge portion;

a lower surface;

at least one vertical fold for general alignment with the means for connecting the front and rear covers together;

a first horizontal fold extending generally parallel to said lower surface and spaced therefrom;

support fastener holes positioned between said first horizontal fold and said lower surface; and a second horizontal fold generally parallel to and spaced upwardly from said first horizontal fold so that said support sheet further includes:

a generally horizontal support ribbon above said second horizontal fold; and a generally horizontal base ribbon above said first horizontal fold and below said second horizontal fold; and fasteners extending through said support fastener for attachment through the cover fastener holes, whereby when said support is connected to a protector and said base ribbon is folded outwardly from the front and rear covers and said upper edge portion is placed in engagement with the connection means, the lower edge and said second horizontal fold are positioned for engagement with a flat generally horizontal supporting surface so that the protector can be supported generally upright thereby.

32. The support as defined in claim 31 wherein each of said fasteners include:

an upset rivet.

33. The support as defined in claim 31 wherein each of said fasteners include:

a rivet integral to said support sheet.

34. The support as defined in claim 31 wherein each of said fasteners include:

a headed screw; and a T nut.

35. The support as defined in claim 31 wherein said support sheet includes in addition to said at least one vertical fold:

a second vertical fold spaced from said first vertical fold.

36. The support as defined in claim 35 further including:

a cutout between said first and second vertical folds and between said first horizontal fold and said lower edge.

37. The support as defined in claim 31 wherein said first horizontal fold extending generally parallel to said lower surface and spaced therefrom forms:

connection ribbons between said first horizontal fold and said lower edge for positioning along each cover.

38. A display device comprising:

a protector for holding generally planar displays having:

a generally planar front cover;

a generally planar rear cover; and means for connecting said front and rear covers together, said generally planar front and rear covers each including:

an outer surface;

an upper edge;

a lower edge;

connection means positioned generally vertically between said upper and lower edges; and at least one fastener hole formed therein spaced from said lower edge;

fasteners extending through said at least two fastener holes; and a support sheet loosely connected to said front and rear covers at said fastener holes by said fasteners, said support sheet including:

an upper edge portion;

a lower surface;

at least one vertical fold in general alignment with said means for connecting said front and rear covers together;

a first horizontal fold extending generally parallel to said lower surface and spaced therefrom with said fasteners positioned therebetween; and a second horizontal fold generally parallel to and spaced upwardly from said first horizontal fold, said support sheet further including:

a generally horizontal support ribbon above said second horizontal fold; and a generally horizontal base ribbon above said first horizontal fold and below said second horizontal fold, whereby when said base ribbon is folded outwardly from said front and rear covers and said upper edge portion is placed in engagement with said connection means, said lower edge and said second horizontal fold are positioned for engagement with a flat generally horizontal supporting surface so that said protector can be supported generally upright thereby.

39. The display device as defined in claim 38 wherein said at least one fastener hole is a horizontally elongate fastener hole.

40. The display device as defined in claim 38 further including at least two horizontally elongate fastener holes formed in said support sheet through which said fasteners pass.

* * * * *